US010557452B2

(12) United States Patent
Gallatz et al.

(10) Patent No.: US 10,557,452 B2
(45) Date of Patent: Feb. 11, 2020

(54) MICROWAVE SPARK PLUG FOR INJECTING MICROWAVE ENERGY

(71) Applicant: MWI Micro Wave Ignition AG, Empfingen (DE)

(72) Inventors: Armin Gallatz, Empfingen (DE); Volker Gallatz, Sulz-Bergfelden (DE)

(73) Assignee: MWI Micro Wave Ignition AG, Empfingen (DE)

( * ) Notice: Subject to any disclaimer, the term of this patent is extended or adjusted under 35 U.S.C. 154(b) by 448 days.

(21) Appl. No.: 15/009,232

(22) Filed: Jan. 28, 2016

(65) Prior Publication Data

US 2016/0265502 A1 Sep. 15, 2016

(30) Foreign Application Priority Data

Mar. 3, 2015 (EP) ..... 15157298

(51) Int. Cl.
*F02P 23/04* (2006.01)
*H05H 1/46* (2006.01)
*H01P 5/02* (2006.01)

(52) U.S. Cl.
CPC ..... *F02P 23/045* (2013.01); *H01P 5/024* (2013.01); *H05H 1/46* (2013.01); *H05H 2001/463* (2013.01)

(58) Field of Classification Search
CPC .... F02P 23/045; H05H 1/46; H05H 2001/463
USPC ..... 123/143.008
See application file for complete search history.

(56) References Cited

U.S. PATENT DOCUMENTS 4,314,530 A * 2/1982 Giacchetti ..... F02P 23/04 123/143 B
5,414,235 A * 5/1995 Lucas ..... H05H 1/30 219/121.43
5,673,554 A * 10/1997 DeFreitas ..... F02C 7/264 102/200
5,689,949 A * 11/1997 DeFreitas ..... F02C 7/264 219/121.36
5,845,480 A 12/1998 DeFreitas et al.
(Continued)

FOREIGN PATENT DOCUMENTS

DE 102009016665 A1 10/2010
DE 102011116340 A1 4/2013

*Primary Examiner* — Joseph J Dallo
*Assistant Examiner* — Yi-Kai Wang
(74) *Attorney, Agent, or Firm* — Von Rohrscheidt Patents

(57) ABSTRACT

A microwave spark plug for injecting microwave energy into a combustion chamber of an engine including an elongated housing, including an elongated chamber forming a hollow conductor in an interior of the housing, and including a microwave window arranged at a first end of the chamber in the housing, wherein the microwave window closes the hollow conductor relative to the combustion chamber, wherein the hollow conductor includes a connection element for a high frequency feed conductor at a second end arranged opposite to the microwave window, wherein the connection element includes a high frequency inlet cross section geometry which differs from a high frequency outlet cross section geometry at the microwave window. The microwave sparkplug is configured to be threaded into typical boreholes for sparkplugs and facilitates safe injection of microwave energy into a combustion chamber of an internal combustion engine.

17 Claims, 2 Drawing Sheets

(56) References Cited

U.S. PATENT DOCUMENTS

| | | | | |
|---|---|---|---|---|
| 7,770,551 | B2 * | 8/2010 | Gallatz | F02P 23/045 123/143 B |
| 8,074,620 | B2 * | 12/2011 | Filipek | F02B 23/0657 123/143 B |
| 8,783,220 | B2 * | 7/2014 | Smith | F02P 9/007 123/143 R |
| 2003/0041844 | A1 * | 3/2003 | Yoshimoto | F02B 51/06 123/543 |
| 2003/0214210 | A1 * | 11/2003 | Lipp | H01T 13/20 313/118 |
| 2011/0175691 | A1 | 7/2011 | Smith et al. | |
| 2011/0279008 | A1 * | 11/2011 | Korenev | H01T 13/20 313/141 |
| 2013/0120085 | A1 | 5/2013 | Harris | |

* cited by examiner

MICROWAVE SPARK PLUG FOR INJECTING MICROWAVE ENERGY

RELATED APPLICATIONS

This application claims priority from and incorporates by reference European Patent Application 15 157 298.9 filed on Mar. 3, 2015.

FIELD OF THE INVENTION

The instant invention relates to a microwave spark plug for injecting microwave energy into a combustion chamber of an internal combustion engine and to an internal combustion engine with at least one spark plug.

BACKGROUND OF THE INVENTION

DE 10 2009 016 665 A1 illustrates an internal combustion engine in which a fuel air mixture is actively ignited by microwave radiation in order to drive a piston. A microwave conductor is arranged in a cylinder head so that the microwave radiation is introduced into the combustion chamber by a microwave conductor through a ceramic lens which closes the microwave conductor towards the combustion chamber.

When generating a microwave ignition in a combustion chamber it is very important to introduce the microwave energy into the combustion chamber in a controlled manner. Thus, the microwave energy has to be brought proximal to the engine housing by suitable hollow conductors and then has to be injected into the combustion chamber. Thus, the conditions of high frequency technology have to be considered during wave conduction and it has to be assured that the microwave energy is transmitted in a controlled manner, if possible without unintentional reflections or leaps in the wave modes. Simultaneously it should be also possible to connect existing engines to a microwave energy source without a high level of complexity.

BRIEF SUMMARY OF THE INVENTION

Thus, it is an object of the instant invention to propose a way how to inject microwave energy into existing engines.

The object is achieved according to the invention by a microwave spark plug for injecting microwave energy into a combustion chamber of an engine, the microwave sparkplug including an elongated housing, including an elongated chamber forming a hollow conductor in an interior of the housing, and a microwave window arranged at a first end of the hollow conductor in the housing, wherein the microwave window closes the hollow conductor relative to a combustion chamber of an engine, wherein the hollow conductor includes a connection element for a high frequency feed conductor at a second end of the hollow conductor arranged distal from the microwave window, wherein the connection element includes a high frequency inlet cross section geometry which differs from a high frequency outlet cross section geometry at the microwave window, and wherein a transition from the high frequency entry cross section geometry at the first end of the hollow conductor to the high frequency outlet cross section geometry at the second end of the hollow conductor is provided continuously.

Further advantageous embodiments can be derived from the dependent claims.

The object is furthermore achieved an internal combustion engine with the microwave spark plug according to the invention.

It is a particular feature that the spark plug is easily insertable in bore holes in the engine housing, for example in the cylinder head of the reciprocating piston internal combustion engine. Thus, the microwave spark plug includes an elongated housing which includes an internal elongated conical chamber forming a hollow conductor and which includes a microwave window at one end of the hollow conductor, wherein the microwave window closes the hollow conductor towards the combustion chamber. The microwave window is made from a solid temperature stable and microwave permeable material. This, can be for example a ceramic material, advantageously with a purity >99% or another solid microwave permeable material. A microwave spark plug of this type can be introduced into a respective bore hole of an engine housing, wherein the bore hole is connected with the combustion chamber and wherein the microwave spark plug is for example screwed into a thread. The hollow conductor in the microwave spark plug furthermore includes a connection element of a high frequency feed conductor at another end arranged opposite to the microwave window, wherein the microwave energy can be supplied; through the connection element with commercial off the shelf or special high frequency connector elements. Thus, the connector element includes a high frequency inlet cross section geometry which differs from the effective high frequency outlet cross section geometry at the microwave window side end. Gross section geometry means in this context that the geometry is triangular per definition, rectangular, circular, oval or shaped differently, wherein the outlet cross section geometry differs from the inlet cross section geometry. This term shad emphasize that this is the cross section geometry which represents the respective location for the opening for the outlet of the microwave energy. From a configuration point of view this cross section geometry which is effective for the microwave energy can deviate from the cross section geometry at an end of the microwave spark plug, for example so that the housing is circular, a polygonal microwave window is inserted but a circular cross section geometry effective still for the microwave energy because the chamber which is defined by the microwave window is circular. The transition from the high frequency entry cross section geometry at one and of the hollow conductor to the high frequency outlet cross section geometry at the other end of the hollow conductor extends continuously. This is particularly advantageous for transmitting the microwave energy since no mode leaps are caused and a desired cross section geometry can be provided by the same token when injecting the microwave energy into the combustion chamber wherein the cross section geometry is easily sealable relative to the combustion chamber and additionally also facilitates optimization of the entry of the microwave energy into the combustion chamber.

According to another embodiment of the invention the transition from the high frequency inlet cross section geometry to the high frequency outlet cross section geometry is linear. This facilitates simpler fabrication of the microwave spark plug.

According to another embodiment the high frequency inlet cross section geometry is rectangular and the high frequency outlet cross section geometry is circular or oval in order to implement a symmetrical injecting of the microwave energy into the combustion chamber.

Particularly advantageously an outer circumference of the housing includes a thread for screwing the microwave spark plug into an engine housing enveloping the combustion chamber. This facilitates replacing the microwave spark plugs in a particularly advantageous manner and facilitates threading the microwave spark plugs into existing openings for conventional spark plugs. Particularly advantageously the ratio of an outer diameter of the thread to a diameter of the hollow conductor over the length of the thread is in a range of 1.15 to 1.45.

In order to inject the microwave energy into the combustion chamber with as little refraction and reflection as possible the microwave window is made from a highly pure ceramic material with a purity of >99%, e.g. sapphire glass or quartz glass.

Advantageously the microwave window is configured disc shaped, wherein a side oriented towards the hollow conductor is flat and a side oriented towards the combustion chamber is flat or non-flat. The side oriented towards the combustion chamber can be configured convex or concave or it can have a point configured cone shaped or pyramid shaped. Advantageously the window at the end of the hollow conductor is glued in, pressed in or shrunk in in order to provide safe sealing and simple production.

Advantageously a thickness of the microwave window is half a wave length of the microwave, this means at 3 mm to approximately 7 mm, advantageously 4.5 mm.

According to an advantageous embodiment the thickness of the microwave window is half the wave length or an integer multiple of the half wave length of the electromagnetic wave transmitted by the hollow conductor. This improves reflection properties and reduces reflections. The inner surface of the chamber or of the hollow conductor certainly has to be configured as flat as possible. The surface can thus be coated with a precious metal or can be made from copper in order to improve conductivity.

The microwave spark plug according to the invention can be used in all internal combustion engines like reciprocating piston engines or rotating piston engines. Depending on the application one or plural spark plugs of this type can be arranged in the respective combustion chamber at a suitable location. Additionally protruding tips can be arranged in the combustion chamber for local field boosting and triggering ignitions. The configuration of the microwave spark plug according to the invention facilitates injecting microwave energy into a combustion chamber without having to perform changes at the engine housing in an ideal case.

BRIEF DESCRIPTION OF THE DRAWINGS

Additional features of the invention can be derived from the following description in combination with the drawing figures and the patent claims. Individual features can be implemented by themselves or in combination in embodiments of the invention, wherein:

DETAILED DESCRIPTION OF THE INVENTION

Figure 1A:
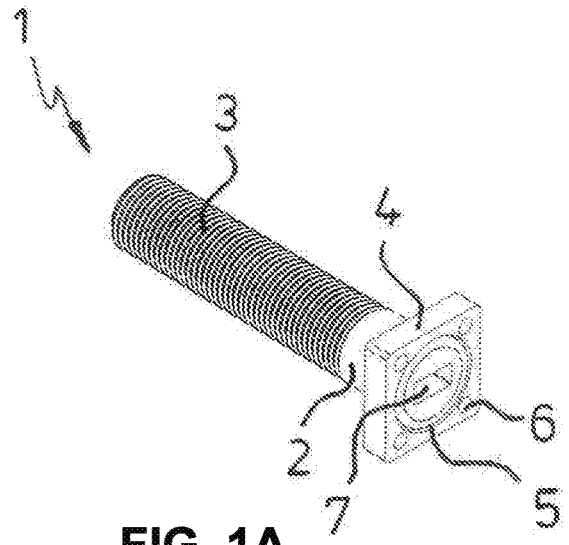
FIG. 1A illustrates a perspective view of a flange of a microwave sparkplug.
Figure 1B:
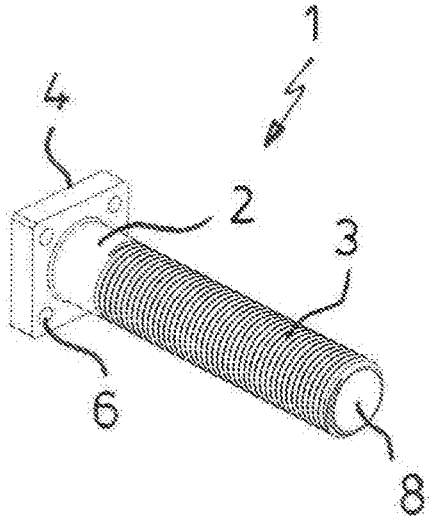
FIG. 1B illustrates a perspective view of a microwave window of a microwave sparkplug.

The perspective views of FIG. 1A and FIG. 1B illustrate the microwave spark plug 1 with an elongated housing 2 on which a thread 3 is arranged for threading into a respective bore hole in an engine. The diameter of the microwave spark plug 1 with the thread 2 corresponds to typical diameters for conventional spark plugs. At one end of the housing 2 there is a flange 4 with bore holes 6 and a groove 5 for receiving a seal ring 9 that is not illustrated in this figure, wherein a connecting conductor of a hollow conductor for transmitting the microwaves is attachable at the seal ring 9. The attachment requires a precise match of the mechanically connected/flanged on hollow conductor interior geometry and the interior geometry of the MW spark plug. Thus, all types of attachments like form coded plug connectors or suitable quick connectors are useable. In the flange there is a rectangular opening for injecting in the microwave energy. At the other end of the longitudinal housing as evident from FIG. 1B a ceramic disk 8 configured as a microwave window is arranged which can be pressed in, glued in or shrunk in.

Figure 2A:
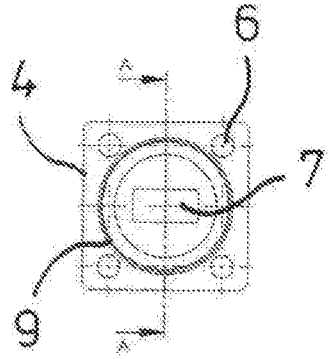
FIG. 2A illustrates a face view of the microwave sparkplug.
Figure 2B:
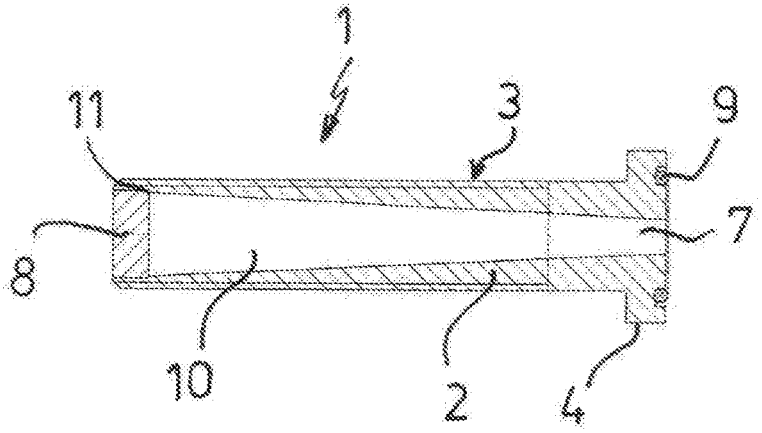
FIG. 2B illustrates a longitudinal sectional view of the microwave spark plug along the line A-A.

FIG. 2 illustrates a face view of the flange 4 in FIG. 2A and the sectional line through the microwave spark plug 1 along the line A-A. FIG. 2B illustrates the sectional view through the microwave spark plug 1 along the sectional line A-A with a seal ring 9 inserted into the groove 5 at the flange 4 and the inserted ceramic disc 8 at the other end of the housing 2. FIGS. 2A and 2B show the thread 3 and in an interior of the housing a chamber 10 is shown which is used as a hollow conductor for the microwave energy and whose height expands in a linear manner from the height of the opening 7 up to a height that is approximated to the diameter of the ceramic disc 8. The diameter of the ceramic disc 8 is slightly larger so that it provides a stop 11 in the housing 2 for the ceramic disc 8.

Figure 3A:
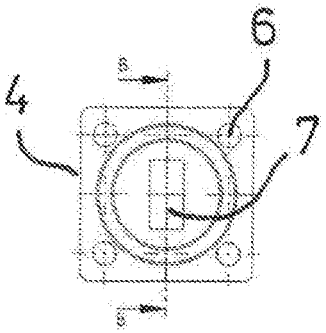
FIG. 3A illustrates a face view of the microwave spark plug that is rotated by 90° relative to the view in FIG. 2A.
Figure 3B:
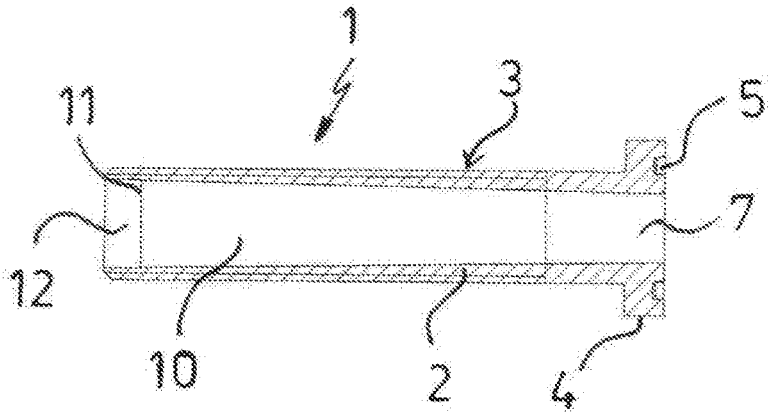
FIG. 3B illustrates a longitudinal sectional view along the line B-B through the microwave spark plug wherein the view is rotated by 90° relative to the view in FIG. 2B.

FIG. 3 similar to FIG. 2 illustrates a face view of the flange with the sectional line B-B in FIG. 3A, this time without the seal ring 9 illustrated in FIG. 2. FIG. 3B illustrates a longitudinal sectional view through the microwave spark plug 1 wherein the ceramic disc 8 is also removed in this illustration so that a face opening 12 with a stop 11 is visible in the housing 2 for receiving the ceramic disc 8. The chamber 10 also expands in this embodiment from a width of the opening 7 in a linear manner up to the stop 11 so that in combination of FIGS. 2 and 3 the hollow conductor 10 has a circular configuration at the stop 11 at the microwave window.

Since the ceramic disc 8 is arranged in a recess with a stop 11 it is larger than the effective cross section of an outlet geometry in the hollow conductor 10 shortly before the stop 11. Theoretically the ceramic disc 8 can also have a totally different shape than the outlet cross section of the hollow conductor 10 which is circular in the embodiments.

Figure 4:
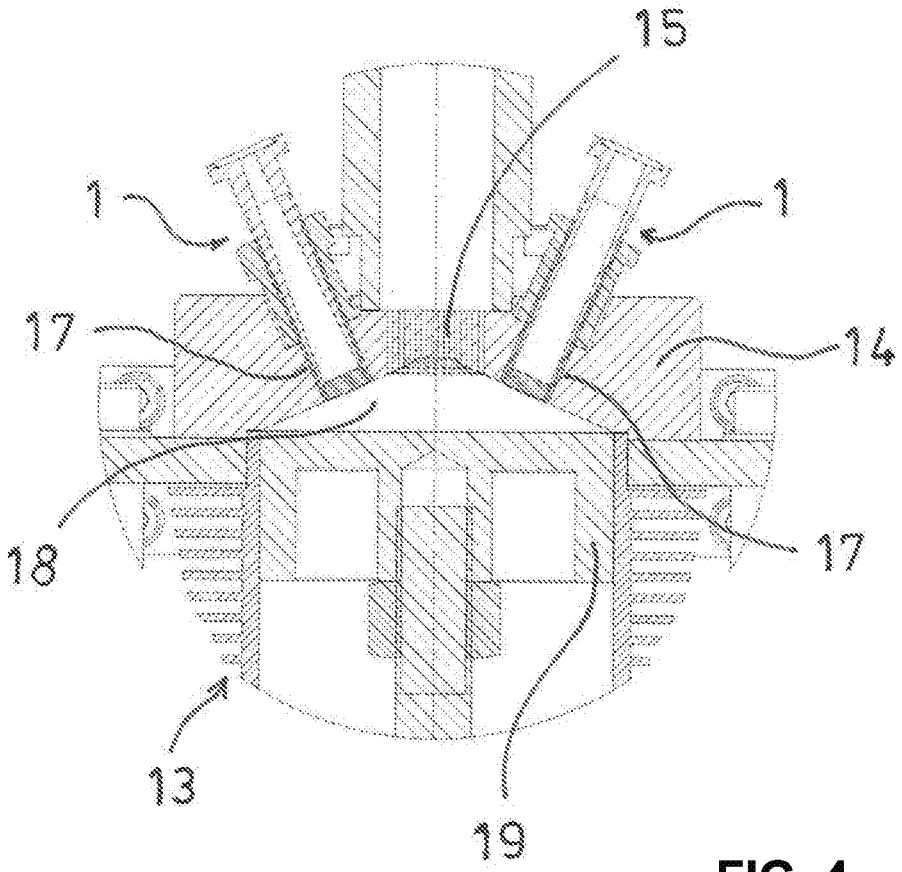
FIG. 4 illustrates a cylinder head of a reciprocating piston engine with a microwave spark plug.

FIG. 4 illustrates a schematic detail of a cylinder 13 of a piston engine with a cylinder head 14, a piston 19 and an inlet portion 15 made from a plurality of openings. An outlet from the piston 19 is not illustrated and can be provided in any known typical manner. Two bore holes 17 are provided in the cylinder head wherein a respective microwave spark plug 1 is screwed into each bore hole in order to inject the microwave energy through the microwave window 8 into a combustion chamber 18. It is helpful to inject in microwave energy with identical frequency and identical phase in particular engine operating ranges. By the same token a frequency deviation and a phase shift is required in other engine operating ranges. Therefore it can be necessary to use different inner geometries of the microwave spark plugs. In the embodiment a reciprocating piston engine is illustrated in an exemplary manner wherein the spark plug can certainly also be used for a rotating piston engine. Thus, the microwave spark plug for injecting in the microwave energy can be used for all engine types in which ignition is desirable in the combustion chamber that is caused by microwave energy.

What is claimed is:

1. A microwave spark plug for injecting microwave energy into a combustion chamber of an engine, the microwave sparkplug comprising:

an elongated housing, including an elongated chamber forming a hollow conductor in an interior of the housing, and a microwave window arranged at a first end of the hollow conductor in the housing, wherein the microwave window closes the hollow conductor relative to a combustion chamber of an engine, wherein the hollow conductor includes a connection element for a high frequency feed conductor at a second end of the hollow conductor arranged distal from the microwave window, wherein the connection element includes a high frequency inlet cross section geometry which differs from a high frequency outlet cross section geometry at the microwave window, wherein a transition from the high frequency entry cross section geometry at the first end of the hollow conductor to the high frequency outlet cross section geometry at the second end of the hollow conductor is provided continuously expanding from the second end to the first end of the hollow conductor, and wherein a thread for threading into an engine housing defining the combustion chamber is arranged at an outer circumference of the elongated housing.

2. The microwave spark plug according to claim 1, wherein a ratio of an outer diameter of the thread to a diameter of the hollow conductor is in a range of 1.15-1.45 over a length of the thread.

3. The microwave spark plug according to claim 1, wherein an inner wall surface of the hollow conductor is made from a material with good electrical conductivity.

4. The microwave spark plug according to claim 1, wherein the microwave window is made from a highly pure ceramic material with a purity greater than 99%.

5. The microwave spark plug according to claim 4, wherein the microwave window is configured disc shaped, and wherein a side of the microwave window oriented towards the hollow conductor is flat and another side of the microwave window oriented towards the combustion chamber is configured flat or non-flat.

6. The microwave spark plug according to claim 5, wherein the microwave window is glued, pressed or shrunk into the housing at the first end of the hollow conductor.

7. The microwave spark plug according to claim 1, wherein a thickness of the microwave window is half a wave length or an integer multiple of half the wave length of an electromagnetic wave transmitted by the hollow conductor.

8. An internal combustion engine, comprising at least one bore hole configured for threading in at least one spark plug;

at least one combustion chamber including at least one inlet valve and at least one outlet valve, wherein a microwave spark plug according to claim 1 is arranged in the at least one bore hole.

9. The microwave spark plug according to claim 4, wherein the highly pure ceramic material is sapphire glass or quartz glass.

10. The microwave spark plug according to claim 3, wherein the material with good electrical conductivity is copper or a noble metal.

11. A microwave spark plug for injecting microwave energy into a combustion chamber of an engine, the microwave sparkplug comprising:

an elongated housing, including an elongated chamber forming a hollow conductor in an interior of the housing, and a microwave window arranged at a first end of the hollow conductor in the housing, wherein the microwave window closes the hollow conductor relative to a combustion chamber of an engine, wherein the hollow conductor includes a connection element for a high frequency feed conductor at a second end of the hollow conductor arranged distal from the microwave window, wherein the connection element includes a high frequency inlet cross section geometry which differs from a high frequency outlet cross section geometry at the microwave window, wherein a transition from the high frequency entry cross section geometry at the first end of the hollow conductor to the high frequency outlet cross section geometry at the second end of the hollow conductor is provided continuously expanding from the second end to the first end of the hollow conductor, and wherein a transition from the high frequency inlet cross section geometry to the high frequency outlet cross section geometry is provided linear.

12. A microwave spark plug for injecting microwave energy into a combustion chamber of an engine, the microwave sparkplug comprising:

an elongated housing, including an elongated chamber forming a hollow conductor in an interior of the housing, and a microwave window arranged at a first end of the hollow conductor in the housing, wherein the microwave window closes the hollow conductor relative to a combustion chamber of an engine, wherein the hollow conductor includes a connection element for a high frequency feed conductor at a second end of the hollow conductor arranged distal from the microwave window, wherein the connection element includes a high frequency inlet cross section geometry which differs from a high frequency outlet cross section geometry at the microwave window, wherein a transition from the high frequency entry cross section geometry at the first end of the hollow conductor to the high frequency outlet cross section geometry at the second end of the hollow conductor is provided continuously expanding from the second end to the first end of the hollow conductor, wherein a transition from the high frequency inlet cross section geometry to the high frequency outlet cross section geometry is provided linear, and wherein the high frequency inlet cross section geometry is rectangular and the high frequency outlet cross section geometry is circular or oval.

13. The microwave spark plug according to claim 1, wherein the hollow conductor expands from the first end to the second end.

14. The microwave spark plug according to claim 1, wherein the high frequency inlet cross section is substantially rectangular and the high frequency outlet cross section is substantially circular.

15. The internal combustion engine according to claim 8, wherein the high frequency inlet cross section is substantially rectangular and the high frequency outlet cross section is substantially circular.

16. The microwave spark plug according to claim 11, wherein the high frequency inlet cross section is substantially rectangular and the high frequency outlet cross section is substantially circular.

17. The microwave spark plug according to claim 12, wherein the high frequency inlet cross section is substantially rectangular and the high frequency outlet cross section is substantially circular.

* * * * *